US005911214A

United States Patent [19]

Andrews

[11] Patent Number: 5,911,214

[45] Date of Patent: Jun. 15, 1999

[54] SOCCER BALL PROJECTING APPARATUS

[76] Inventor: Alan Andrews, 51 Glenthorne Ave., Charlottetown, Prince Edward Island, Canada, C1A 9B6

[21] Appl. No.: 09/048,198

[22] Filed: Mar. 26, 1998

[51] Int. Cl.[6] ..... F41B 3/03

[52] U.S. Cl. ..... 124/16; 124/36

[58] Field of Search ..... 124/16, 36

[56] References Cited

U.S. PATENT DOCUMENTS

| | | | |
|---|---|---|---|
| 2,153,315 | 4/1939 | Richter . | |
| 3,128,752 | 4/1964 | Andersen | 124/16 |
| 3,779,227 | 12/1973 | Scott | 124/16 |
| 4,122,822 | 10/1978 | Scheiwiller | 124/54 |
| 4,168,695 | 9/1979 | Haller et al. | 124/16 |
| 4,345,577 | 8/1982 | Andersson | 124/16 |
| 4,352,348 | 10/1982 | Griffith | 124/78 |
| 5,249,564 | 10/1993 | Peachey | 124/17 |
| 5,415,150 | 5/1995 | Dallas | 124/16 X |
| 5,465,978 | 11/1995 | Magnone et al. . | |
| 5,562,282 | 10/1996 | Stevenson | 127/16 X |
| 5,619,977 | 4/1997 | Gatin | 124/7 |

FOREIGN PATENT DOCUMENTS

| | | | |
|---|---|---|---|
| 23100/29 | 10/1930 | Australia | 124/16 |
| 25882/30 | 5/1931 | Australia | 124/16 |
| 165921 | 11/1955 | Australia | 124/16 |
| 31655 | 7/1981 | European Pat. Off. . | |

*Primary Examiner*—John A. Ricci
*Attorney, Agent, or Firm*—Mario D. Theriault

[57] ABSTRACT

A soccer ball projecting apparatus comprising a horizontal base frame having wheels affixed thereto for movement of the apparatus about a soccer field, and a sub-frame which is movably mounted on the base frame. The sub-frame supports a mechanism for projecting a soccer ball, and a soccer ball support cup assembly for supporting a soccer ball in operational association with the mechanism for projecting a soccer ball. The apparatus further comprises a first chain and sprocket drive and motor for rotating the sub-frame within a horizontal plane above the base frame. The ball projecting mechanism is thereby rotatable from side to side for projecting soccer balls to soccer players on both sides of a soccer field without displacing the apparatus in the field. Other aspects of the present invention comprises the ability to adjust the striking path of the striking leg member for lobbing a ball without losing impact force on the ball, and the provision of a chain and sprocket drive for cocking a pair of springs connected to the leg member, with a detection device and a microprocessor for monitoring the number of teeth on the driven sprocket when the springs are being cocked, whereby the striking power of the leg member is adjustable by increments which are inversely proportional to the number of teeth on the driven sprocket.

20 Claims, 10 Drawing Sheets

SOCCER BALL PROJECTING APPARATUS

FIELD OF THE INVENTION

This invention relates to training apparatus for launching soccer balls, and more particularly the present invention relates to apparatus for launching soccer balls in a multiplicity of directions, projecting forces and curving and lobbing trajectories.

BACKGROUND OF THE INVENTION

Ball projecting apparatus have been used in the past to train players of various sports, and in particular soccer players. Professional soccer players are true artists in their field in that they are capable of intercepting a high speed ball with their bodies, and to strike this ball with an astounding precision and velocity. A good soccer player, however, needs more than natural strength, instinct, agility and acute reflexes. A good soccer player is formed through practice, and can only retains his/her keen abilities through continuous practising. Therefore, there is a significant demand by sport organizations for soccer ball projecting apparatus capable of launching balls at various angles, directions and power for training soccer players.

One type of soccer ball projecting apparatus of the prior art is described in U.S. Pat. No. 4,122,822 issued on Oct. 31, 1978 to Kurt Scheiwiller. The machine has a wooden striking member which is operable at different striking forces by a cam mechanism rotating against the striking member. The intensity with which the striking member strikes the ball is adjustable by varying the speed of the cam mechanism. The striking angle or the height of the ball's trajectory is adjusted by varying the height of the shooting platform relative to the ground. This is effected by working a crank handle on a rack and pinion actuator. The adjustment of the speed of the cam mechanism is effected by working a crank wheel on a variable speed drive unit.

A second soccer ball projecting apparatus is disclosed in European Patent Application 31,655, filed in Dec. 8, 1980 by Alberto Mendez Ibarguen. The apparatus disclosed in this document has a kicker bar which is actuated by a drive wheel and a link bar connected to the drive wheel such that the movement of the kicker bar is directly related to the rotation of the drive wheel. A ball projecting motion is initiated by manually actuating a clutch mechanism to cause the drive wheel to engage with a drive motor, and to rotate one turn. The machine further has a pedestal for supporting the ball. The pedestal is mounted on linear bearing and slide assemblies and is movable along two horizontal axis by means of two linear screws and ball nut mechanisms. The ball receiving cradle is mounted on a vertical screw and its position is adjustable along a vertical axis such that the ball is positional along three axes relative to the kicker bar.

Another soccer ball projecting apparatus of the prior art is described in U.S. Pat. No. 4,352,348 issued on Oct. 5, 1982 to Lawrence L. Griffith. This apparatus comprises a hopper and a pair of spinning wheels. The rotational speed of the spinning wheels is adjustable and as well as the common alignment of the wheels. The balls are fed from the hopper and between the spinning wheels to impart to each ball a desired velocity and direction.

In a further example of soccer ball launching apparatus, the U.S. Pat. No. 5,465,978 issued on Nov. 14, 1995 to Jean-Pierre Magnone et al., discloses an apparatus wherein the power of the ejection arm thereof is adjustable, and the position of the ball relative to the ejection arm is also adjustable. The ejection arm is mounted on an axle which in turn is mounted on bearing and provided with a return spring. A launching arm is also mounted on the axle, and is actuated by a drive arm which strikes the launching arm in rotation. The drive arm comprises adjustment means which permits varying its radius so as to transmit more or less power to the launching arm. The launching station has a cradle for supporting the ball, and the cradle is adjustable in horizontal and vertical directions relative to trajectory of the ejection arm.

Another apparatus using a cam and a spring to pre-load the launching arm is disclosed in U.S. Pat. No. 4,168,695 issued on Sept. 25, 1979 to Jack S. Haller et al. Yet another apparatus using a pair of cam wheels to pre-load the launching arm is disclosed in U.S. Pat. No. 4,345,577 issued on Aug. 24, 1982 to Uno K. T. Andersson.

In a further document of the prior art, the U.S. Pat. No. 5,619,977 issued on Apr. 15, 1997 to Walter L. Gatin discloses an apparatus having a catapult-type throwing arm which is pivotally mounted inside an enclosure. The loading of the throwing arm is effected by pulling on a cable extending from the forward end of the enclosure for causing the throwing arm to rotate while extending a spring and to ultimately engage with a vacuum cup. The vacuum cup holds the throwing arm for a nominal period of time before the ball is ejected. As the throwing arm is released, a mechanism attached to the throwing arm causes a gate to open and to let the ball out of the apparatus. The use of a gate makes the ball throwing apparatus safer to use by enclosing the moving parts of the apparatus.

Modern soccer training techniques require that an apparatus for projecting soccer balls should have the ability to change the horizontal trajectory of the ball without physically displacing the apparatus on the ground; that the machine should be capable of lobbing a ball without imparting a spinning effect in it; and that any adjustments to the machine should be effected quickly for concurrently practising a number of players positioned all over a soccer field for example.

It is these reasons basically, that have contributed to the development of a market demand for a better soccer ball projecting apparatus capable of unexpectedly delivering a soccer ball over a wide segment of a soccer field with a multiplicity of projecting forces and curving and lobbing trajectories.

SUMMARY OF THE INVENTION

In the present invention, however, there is provided a soccer ball projecting apparatus which has the ability to launch soccer balls with precisely adjustable intensity, with various lob and side curves and in different directions over a wide segment of a soccer field.

In accordance to a first aspect of the present invention the apparatus of the present invention comprises broadly, a horizontal base frame having wheels affixed thereto for movement of the apparatus about a soccer field and a sub-frame which is movably mounted on the base frame. The sub-frame supports a mechanism for projecting a soccer ball, and a soccer ball support cup assembly for supporting a soccer ball in operational association with the mechanism for projecting a soccer ball.

The mechanism for projecting a soccer ball comprises an arcuated structure which is adjustable about a pair of horizontal pivots affixed to the sub-frame. The mechanism also comprise a linear actuator connected to the arcuated structure for adjusting a radial orientation of the arcuated structure about a common axis of the horizontal pivots, for changing the orientation of the arcuated structure for optionally lobbing a soccer ball.

The mechanism for projecting a soccer ball further comprises a string leg member having a striking path oriented toward the common axis of both horizontal pivots, and the common axis is oriented through a soccer ball when the soccer ball is being supported by the support cup assembly, such that the radial orientation of the striking leg member, and the striking path thereof are adjustable to aim toward a centre of the soccer ball, from various positions of the arcuated structure about the common axis.

The advantage of this mechanism is that the ball can be lobbed to various extent without losing any striking power from the striking leg member. The impact point of the leg member against the ball is always imparted near the centre of the ball for transmitting to the ball a maximum inertia of the striking leg member. The soccer balls projected by the apparatus of the present invention have similar trajectories and bearings as those stricken by experienced soccer players.

In accordance to another aspect of the present invention, the apparatus further comprises a first chain and sprocket drive and a motor for rotating the sub-frame within a horizontal plane above the base frame. The ball projecting mechanism is thereby rotatable from side to side for projecting soccer balls to soccer players on both sides of a soccer field, and for training a goal tender by shooting balls over the entire area of a soccer goal without displacing the apparatus in the field.

In accordance to a further aspect of the present invention, the striking leg member has a first end pivotally connected to the arcuated structure for pendulous movement of the leg member along a striking path. The mechanism for projecting a soccer ball further comprises a crank shaft pivotally mounted on the arcuated structure and having an axis of rotation perpendicular to the striking path. A second chain and sprocket drive is mounted on the arcuated structure and is connected to the crank shaft for rotating the crank shaft. The mechanism for projecting soccer ball further has a compressible spring assembly connected between the crank shaft and the leg member for moving the leg member along the striking path between a cocked position and a striking position and vice-versa, upon a rotation of the crank shaft. The mechanism for projecting soccer balls further has a latch mechanism for detachably retaining the leg member in a cocked position.

In the mechanism of the present invention, the leg member is movable from a striking position to a cocked position upon rotation of the crank shaft a first half-turn, and the spring assembly is compressible upon rotation of the crank shaft a second half-turn when the leg member is adapted to be retained in the cocked position by the latch mechanism. In the mechanism of the present invention there is also provided a proximity or optical switch mounted near the driven sprocket of the second chain and sprocket drive for counting the teeth on the driven sprocket during rotation of the sprocket for compressing the spring assembly. The signals of the proximity or optical switch are thereafter interpreted by a microprocessor to provide an indication of the degree of compression applied to the spring assembly, and thereby, to provide an indication and a control of the striking power of the leg member.

Another advantage of the apparatus of the present invention is that the striking power of the leg assembly is adjustable in very small increments wherein each increment corresponds to the width of one tooth on the driven sprocket. In the apparatus of the preferred embodiment for example, each increment represents 3% of the maximum potential compression of the springs.

In accordance to a yet another aspect of the present invention, there is provided in the apparatus, a number of electric control and electric drive systems for operating the operational functions of the apparatus. There is also provided a pair of batteries mounted on said sub-frame for supplying electric power to the number of electric control and electric drive systems, and a microprocessor connected to the battery and to the number of electric control and electric drive systems for automatically controlling the operational functions of the apparatus.

It will be appreciated that the apparatus of the present invention is thereby programmable for launching successively a number of soccer balls toward a series of predetermined locations according to a specific team training session for example.

BRIEF DESCRIPTION OF THE DRAWINGS

Other advantages of the invention will be apparent from the following description of the preferred embodiment illustrated in the accompanying drawings, in which.

DETAILED DESCRIPTION OF THE PREFERRED EMBODIMENT

Figure 1:
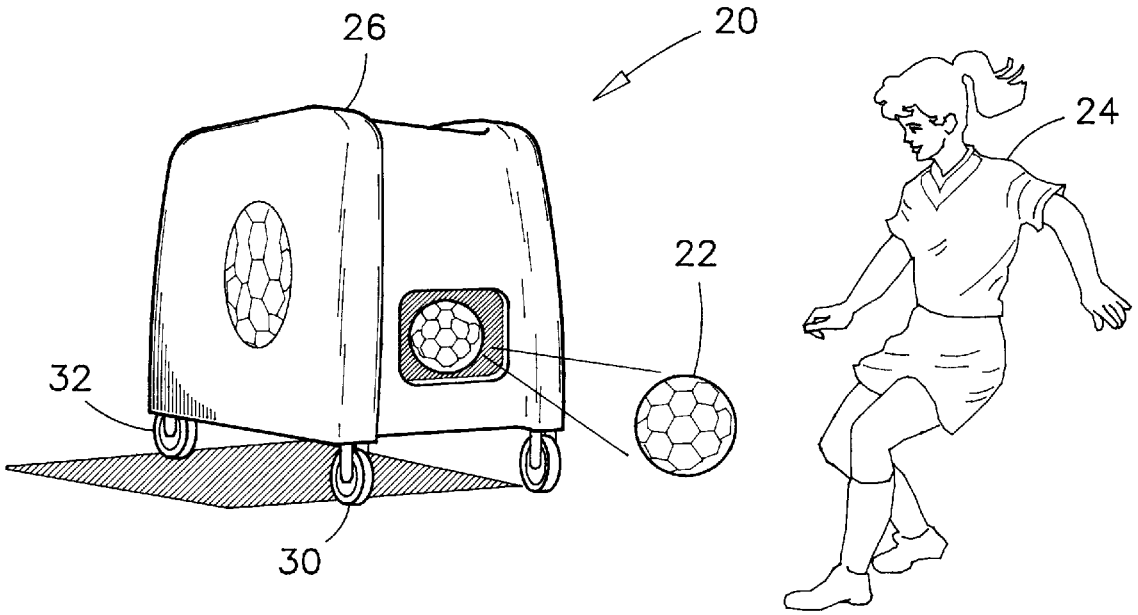
FIG. 1 is a perspective front and right side view of the apparatus of the preferred embodiment in use.
Figure 2:
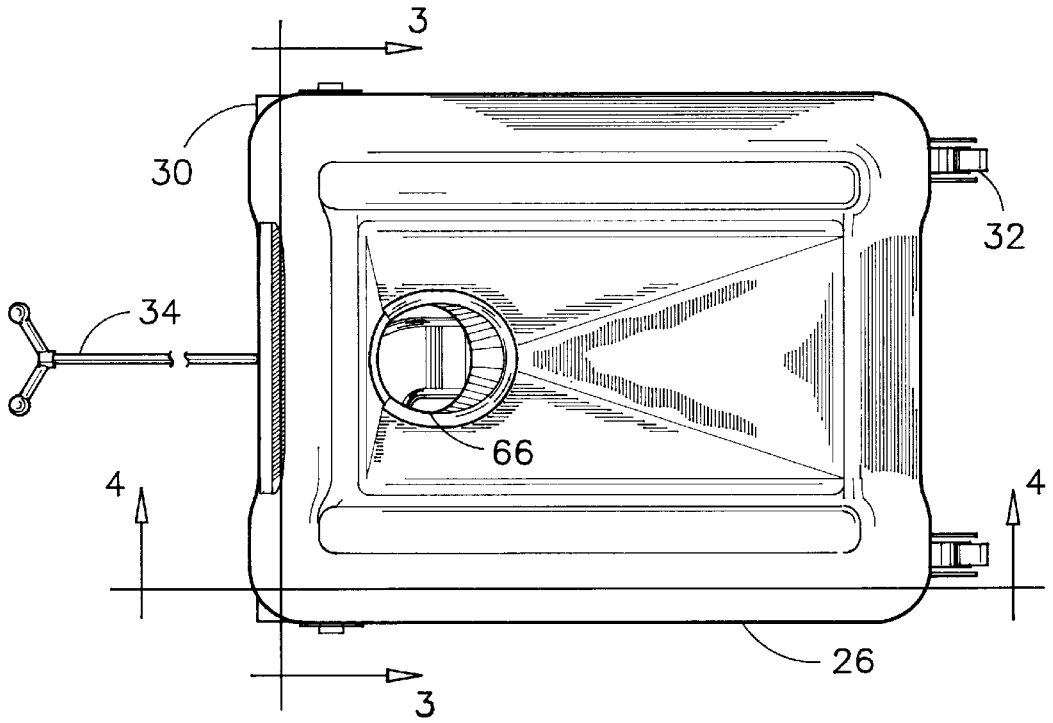
FIG. 2 is top view of the apparatus of the preferred embodiment.
Figure 3:
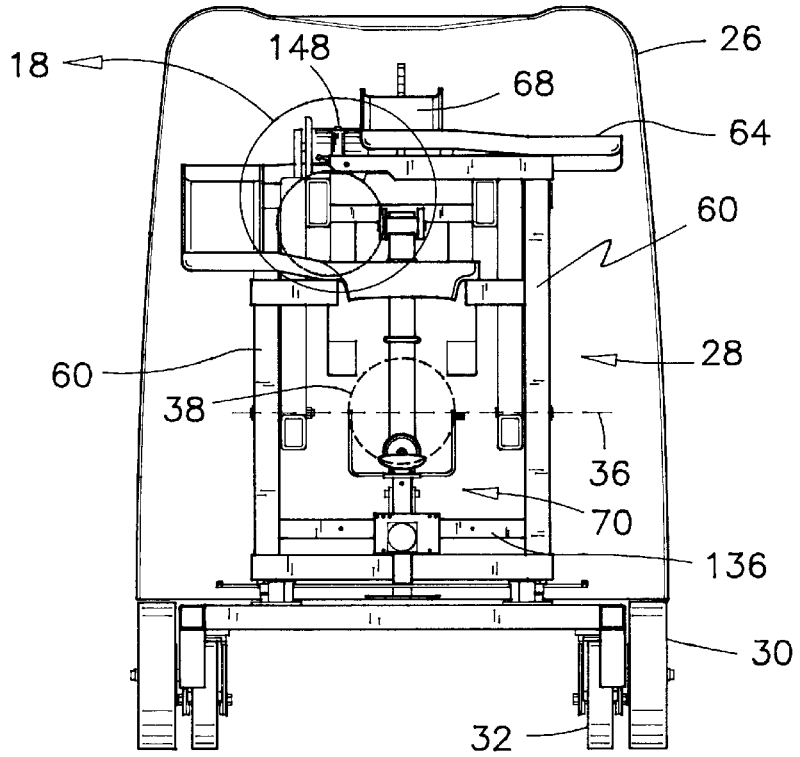
FIG. 3 is a transversal cross-section of the apparatus of the preferred embodiment when viewed along line 3—3 in FIG. 2.
Figure 4:
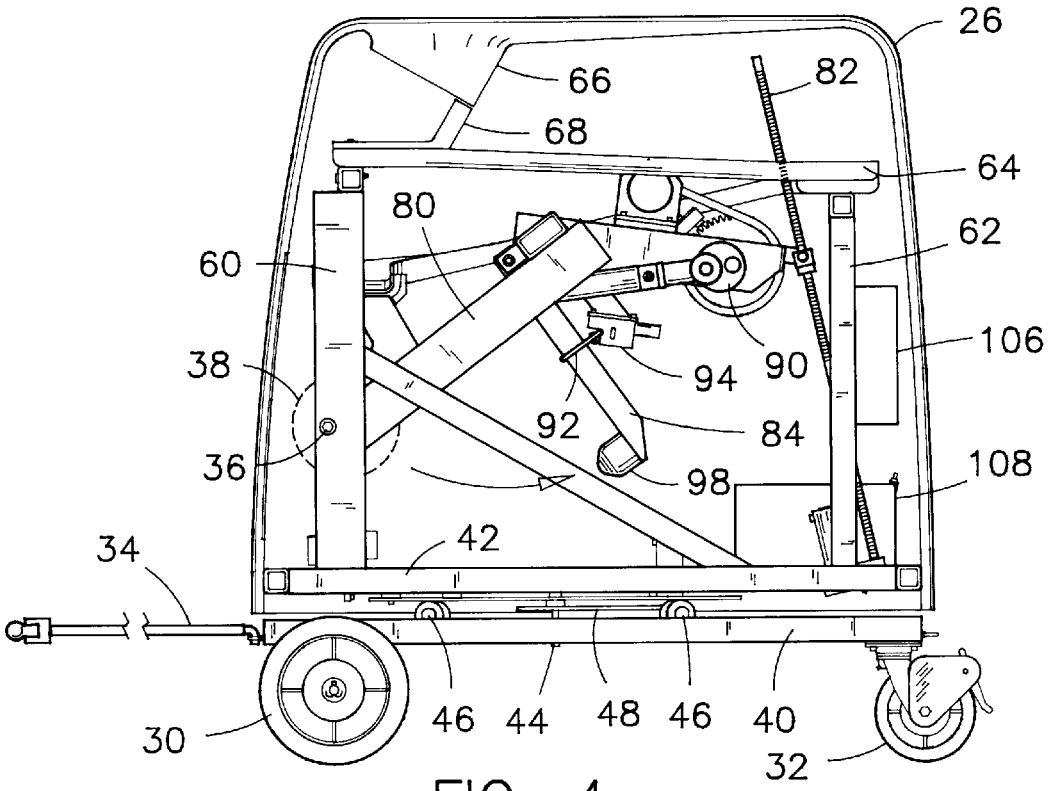
FIG. 4 is a longitudinal cross-section of the apparatus of the preferred embodiment when viewed along line 4—4 in FIG. 2.

The soccer ball projecting apparatus 20 of the preferred embodiment is illustrated in its entirety in FIGS. 1–4. In FIG. 1 in particular, the apparatus 20 of the preferred embodiment is shown shooting a soccer ball 22 to a player 24 during a typical practising session. The apparatus has an enclosure 26 for protecting the ball projecting mechanism 28 from precipitations and dust, and for safely covering the mechanism in use. The apparatus is supported on a pair of front wheels 30 at the front end of the base and a pair of lockable rear wheels 32 at the rear end of the base. A removable handle 34 is attachable to the front end of the base for moving the apparatus about a soccer field.

The principal feature of the projecting mechanism 28 of the apparatus of the preferred embodiment is a spring-actuated ball striking mechanism which swings about a pivot axis 36 passing through a central region of the ball 389 for striking the ball through the centre thereof to duplicate the actual movements of a soccer player. This feature also ensures that the ball 38 is always projected with maximum force. The movements of the spring-actuated ball striking mechanism are illustrated in FIGS. 5 to 10. Other important features of the apparatus of the preferred embodiment comprise the adjustment of the stroke force, projecting direction and the pre-positioning of the soccer ball along three axes, as will be explained herein below.

The apparatus 20 comprises a horizontal rectangular base frame 40 supported by the wheels 30,32 and a sub-frame 42 movably mounted on the base frame 40 about a vertical axis 44. The sub-base 42 is supported on casters 46 affixed to the base frame 40, and is movable about the vertical axis 44 by means of a chain and sprocket drive 48 and a first DC motor 50. The angle of rotation of the sub-frame 42 will be explained later when making reference to FIGS. 11 and 12.

The sub-frame 42 has a pair of spaced-apart upright front members 60 and a pair of upright rear members 62 for supporting a soccer ball storage ramp 64 above the projecting mechanism 28. The enclosure has an opening 66 in the top surface thereof communicating with an inlet portion 68 of the storage ramp 64 for loading the storage ramp 64 with a number of soccer balls.

Figure 15:
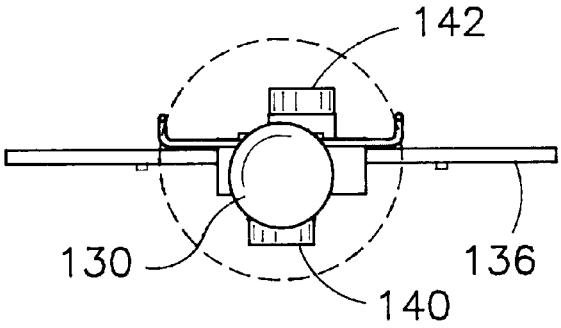
FIG. 15 is a top view of the ball support system.
Figure 13:
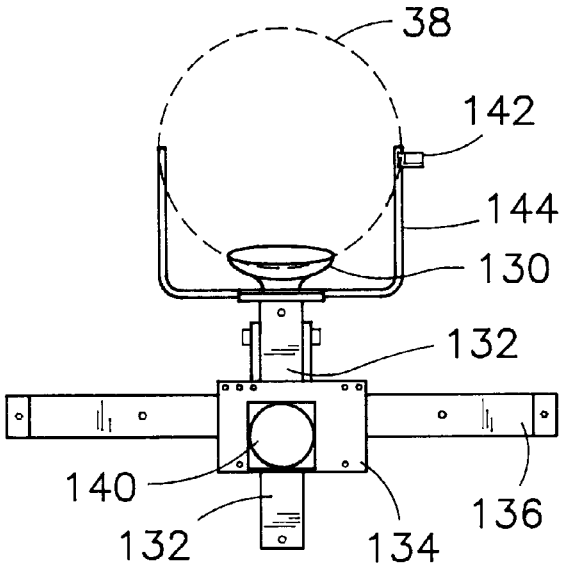
FIG. 13 is a front view of the ball support system.
Figure 14:
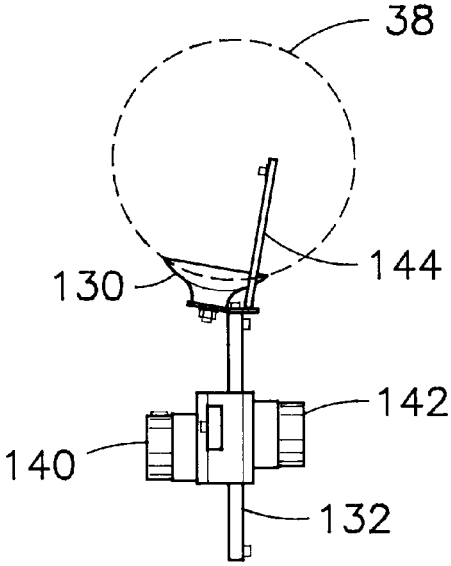
FIG. 14 is a left side of the ball support system.
Figure 16:
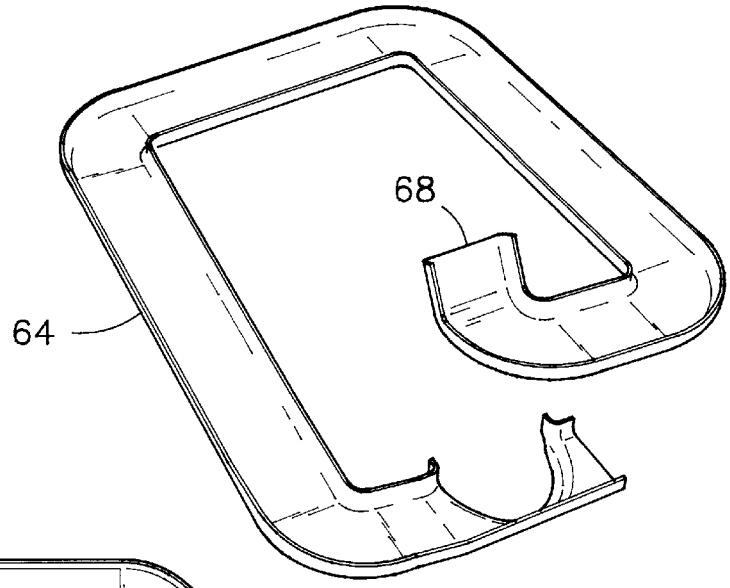
FIG. 16 is a front, top and right side perspective view of the ball storage ramp.
Figure 17:
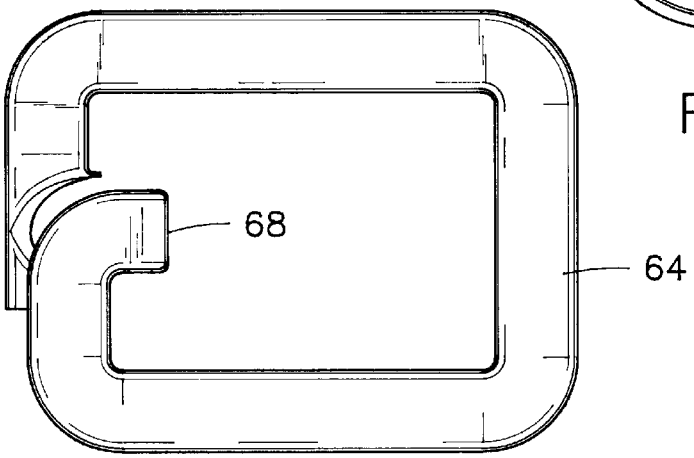
FIG. 17 is a top view of the ball storage ramp.
Figure 18:
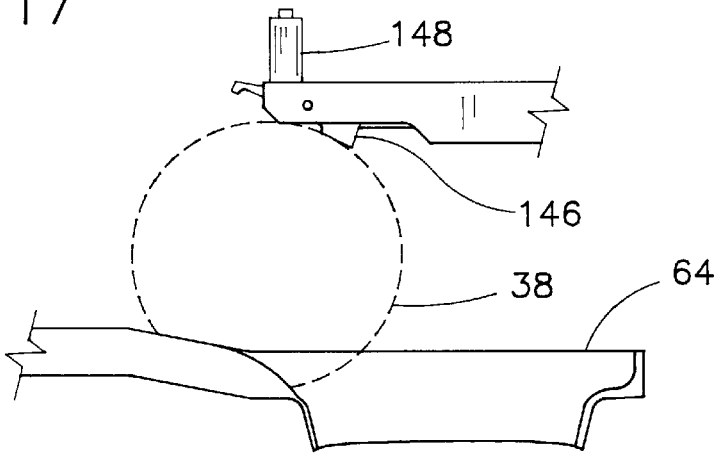
FIG. 18 is an enlarged view of the ball release finger as shown in detail circle 18 in FIG. 3.

The pair of spaced-apart upright front members 60 also supports a ball support cup assembly 70 which will be described later when making reference to FIGS. 13–15. As it was mentioned before, the ball projecting mechanism 28 is pivotally mounted between the upright front members 60 and is movable about transversal horizontal axis 36. The projecting mechanism comprises an arcuated structure 80 having its front end connected to the axis 36 and its rear end connected to a linear actuator 82. A striking leg 84 is pivotally connected to the arcuated frame 80, at pivot 86. The striking leg 84 is operable back and forth by a jolt spring assembly 88 and a crank shaft 90. The striking leg 84 has a boot 98 on its lower end for contacting the ball 38. The boot 98 has concentric grooves on its striking surface for providing a better grip on the ball. The boot is preferably made of aluminum, and covered with a coating of urethane.

Figure 5:
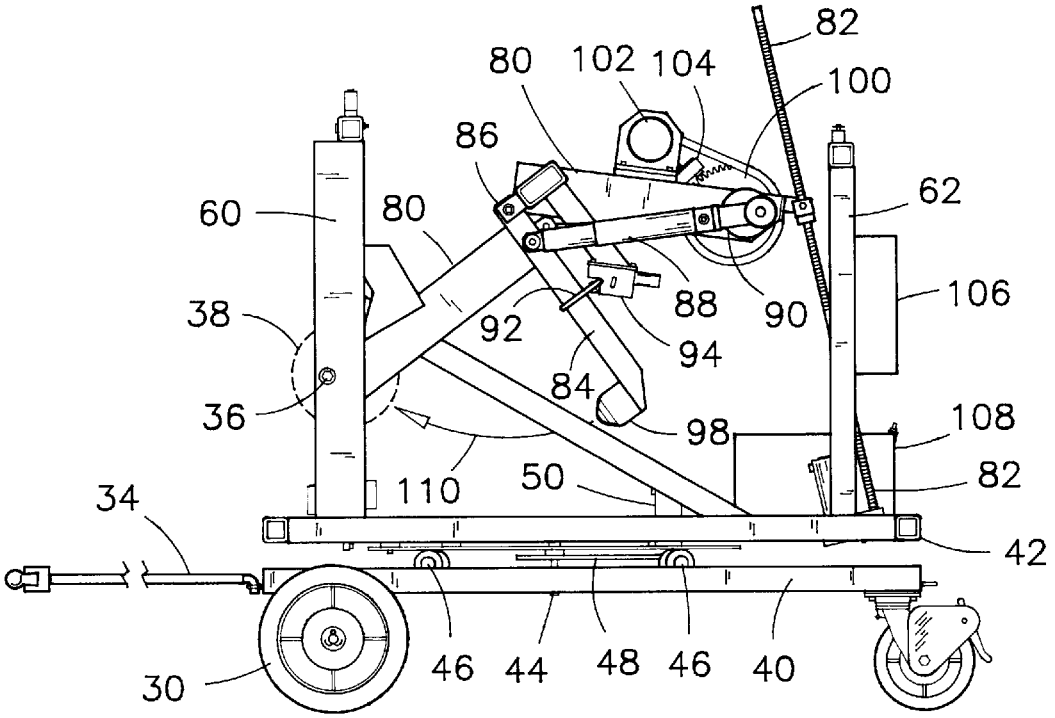
FIG. 5 is a side view of the projecting mechanism in a pre-loading mode.
Figure 6:
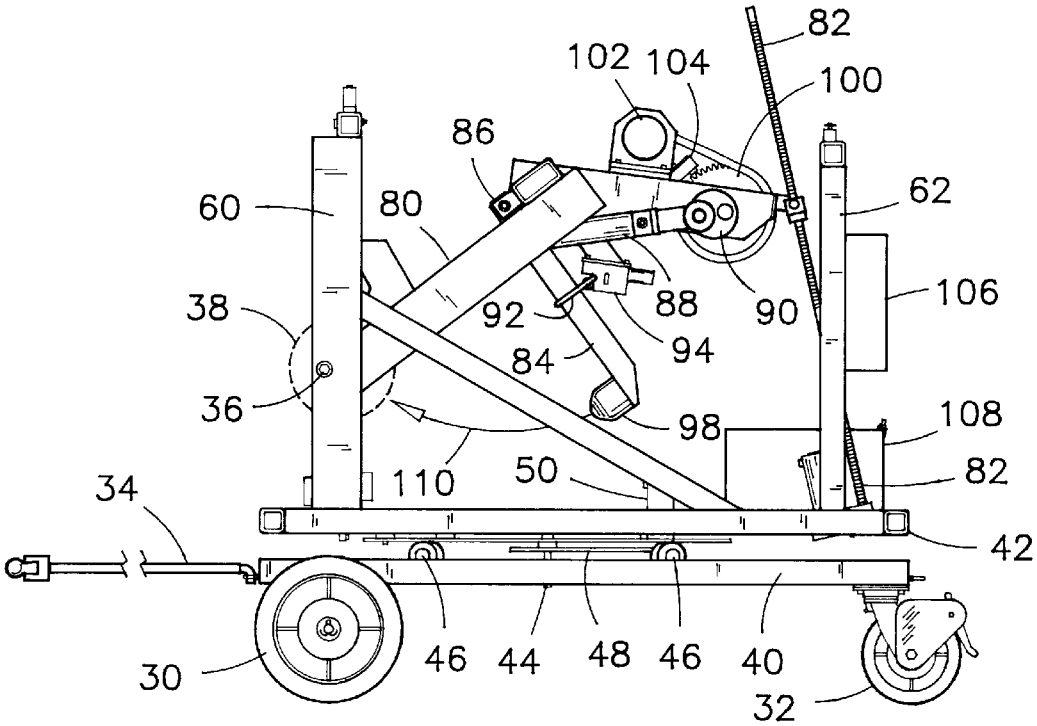
FIG. 6 is a side view of the projecting mechanism in a loaded mode.
Figure 8:
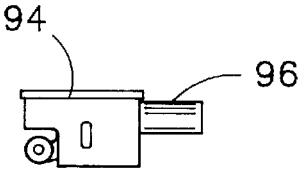
FIG. 8 is an enlarged view of the striking leg latching device.

The illustration in FIG. 5 shows the striking leg 84 being returned to a standby position. The latching of the striking leg 84 into the standby position is effected by rotating the crank shaft 90 such that the jolt spring assembly 88 is pulled backward, as illustrated in FIG. 5, to cause a loop rod 92 on the leg member to engage into a latching mechanism 94. The latching mechanism 94 is operable by a first solenoid operated actuator 96 as illustrated in FIG. 8 for releasing the loop rod 92 and for launching a strike to the ball 38. The crank shaft 90 is rotatable by means of a chain and sprocket drive wherein the driven sprocket is identified by label 100 and a second DC electric motor 102 mounted on the arcuated structure 80 for pulling the striking leg 84 in a standby position, and also for compressing the jolt spring assembly 88. The jolt spring assembly 88 is shown in a fully compressed mode in the illustration of FIG. 6. A first proximity or optical switch 104 is provided on the arcuated frame 80, near the sprocket 100. The proximity or optical switch 104 is positioned for counting the teeth on the sprocket 100 as the sprocket rotates. The count of teeth is communicated to a microprocessor 106 which in mm controls the operation of the motor 102.

It will be appreciated that the number of teeth counted by the proximity or optical switch 104 on the sprocket 100 during the spring compressing cycle of the crank shaft 90 is directly related to the degree of compression of the jolt spring assembly 88, and is directly related to the force with which the ball will be stricken by the leg member 84. The sprocket 100 of the apparatus of the preferred embodiment has 72 teeth and the full compression of the jolt spring assembly 88 requires one half of a turn on the driven sprocket 100. Therefore, it will be appreciated that the power of the jolt spring assembly 88 is adjustable in fractions of 1/36th of a full compression thereof, or by about three percent (3%) increments.

The microprocessor 106 is preferably mounted on the rear upright members 62 and above a pair of batteries 108 supported on the rear end of the sub-frame 42. The batteries supply electrical power to all the motors, switches, actuators and solenoids operating the apparatus of the preferred embodiment.

A linear actuator 82 mounted between the batteries 108 is connected to the rear end of the arcuated structure 80 for raising and lowering the arcuated structure 80 and for correspondingly lobbing the ball with more or less height.

Figure 7:
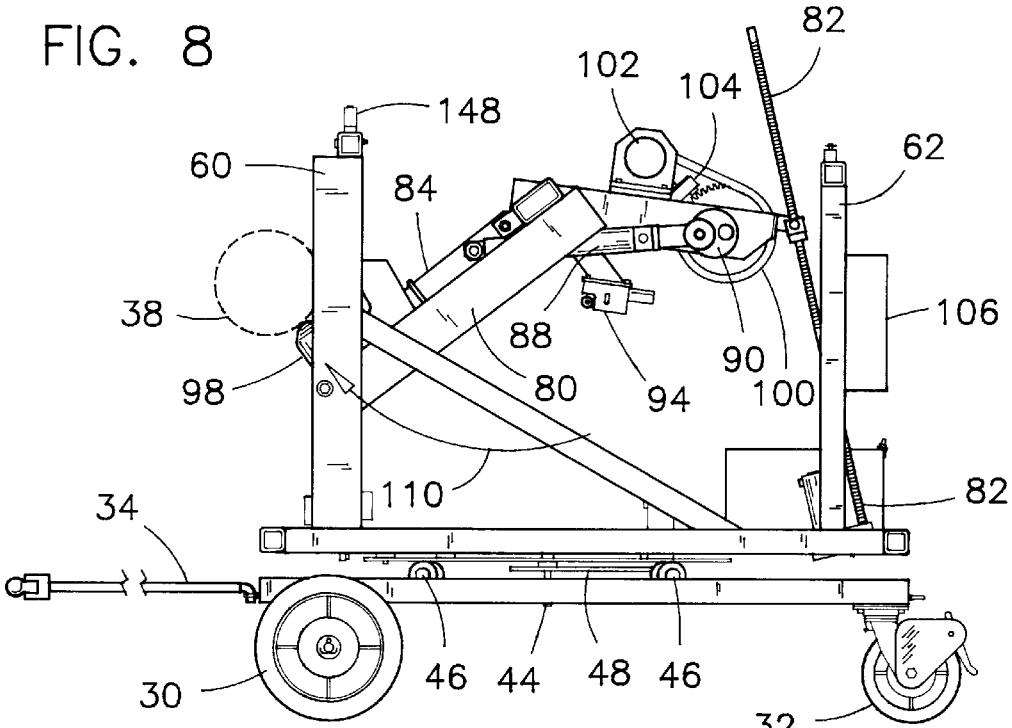
FIG. 7 is side view of the projecting mechanism in a striking mode.
Figure 9:
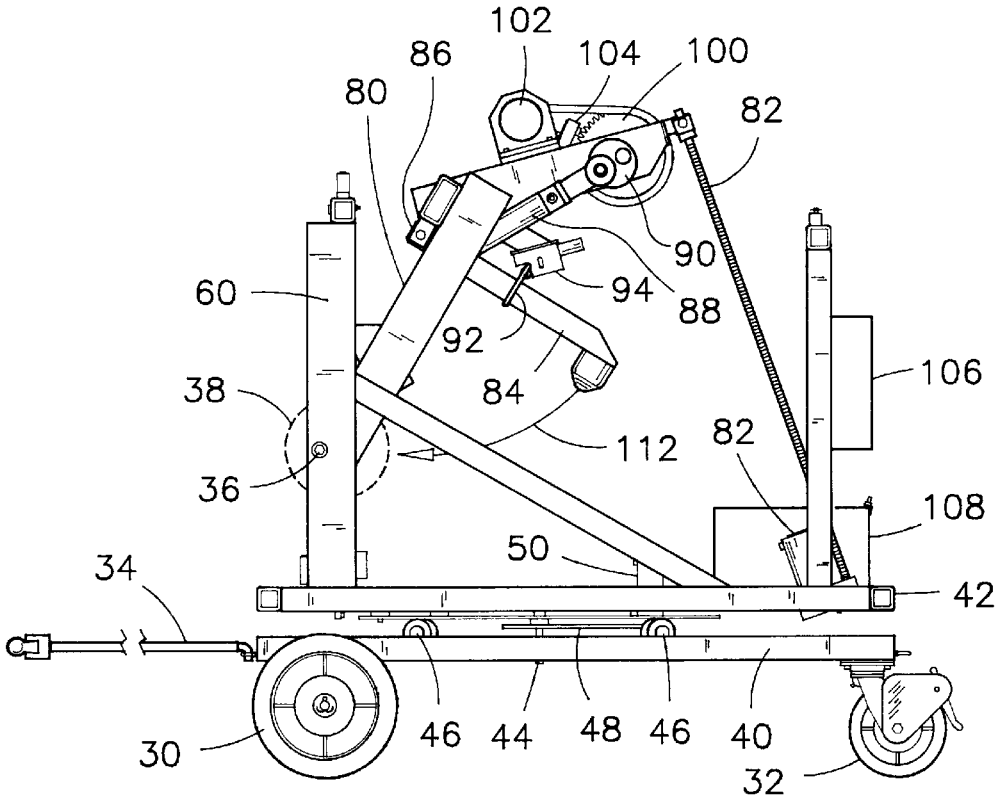
FIG. 9 is a side view of the projecting mechanism in a low lob striking position.
Figure 10:
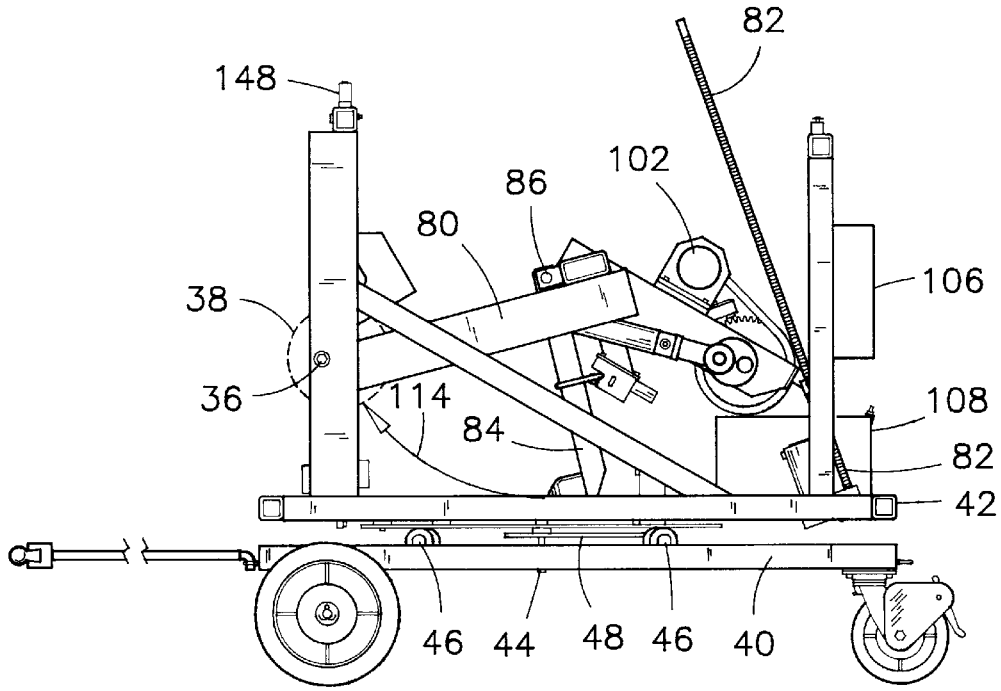
FIG. 10 is a side view of the projecting mechanism in a high lob striking position.

Referring to FIG. 7, the striking leg member 84 is illustrated in a fully extended striking position. In FIGS. 9 and 10, the arcuated structure 80 is shown in upper and lower positions respectively.

It should be noted that the path of the boot 98 whether the arcuated structure 80 is in a high or low position as indicated by arrows 110–114 in FIGS. 7, 9 and 10 respectively is always oriented towards the centre of the ball 38, such that the power of the striking leg is imparted to the ball with maximum efficiency. Conversely, the equipment of the prior art have means for raising or lowering the ball relative to the striking leg in order to lob the ball. Therefore, a spinning motion is also imparted to the ball, and a portion of the leg's power is dissipated in the energy required to impart the spinning motion.

Figure 11:
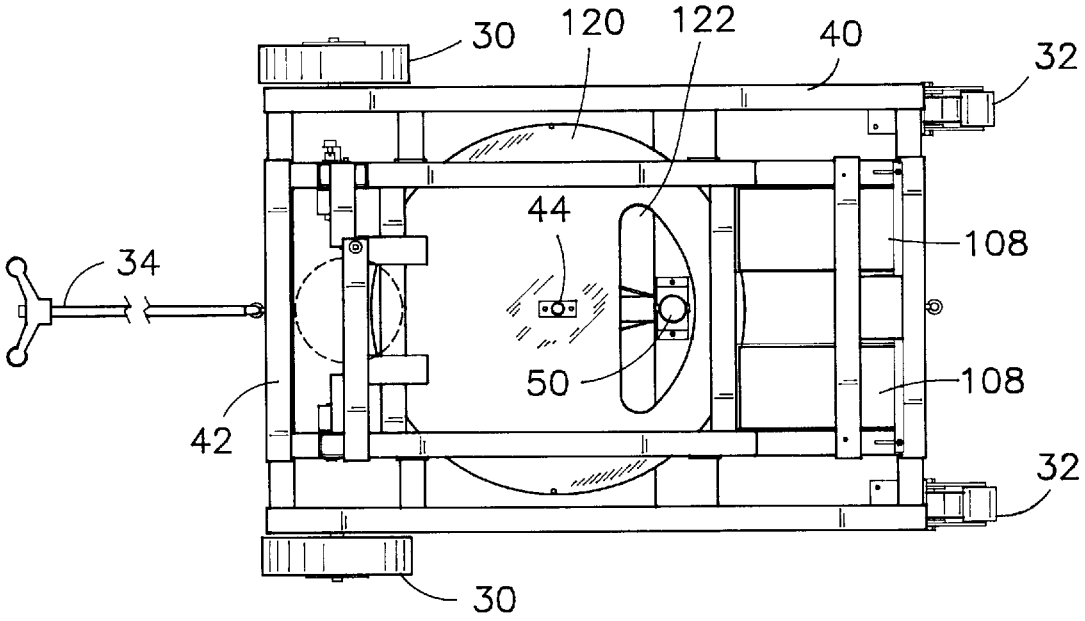
FIG. 11 is a top view of the sub-frame of the apparatus shown in a generally straight alignment.
Figure 12:
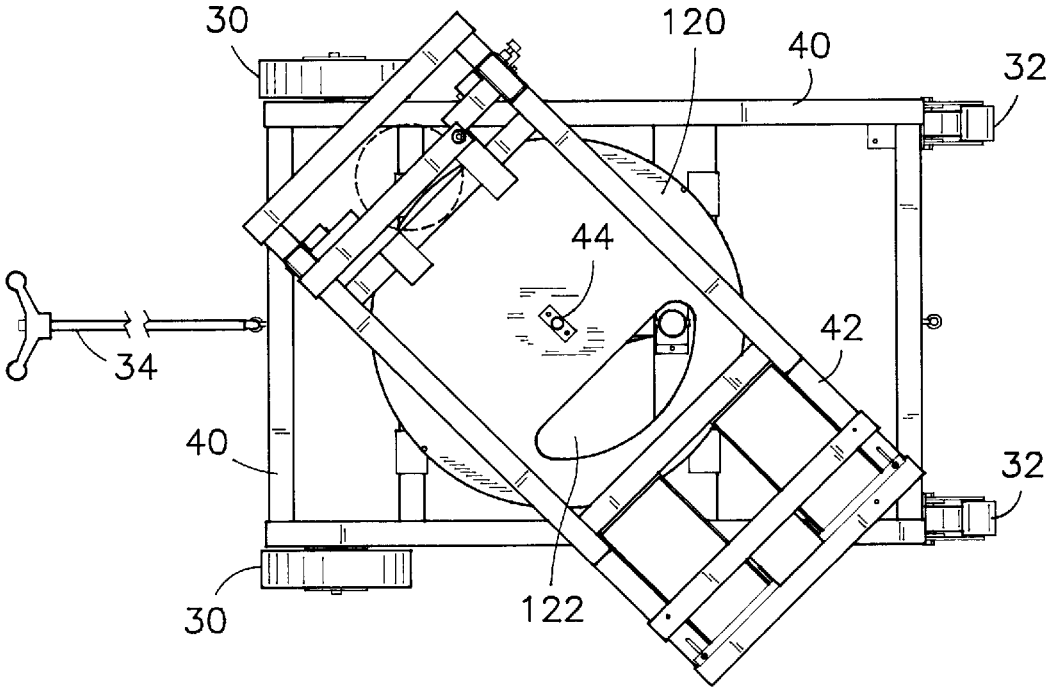
FIG. 12 is a top view of the sub-frame of the apparatus shown in a rightward shooting alignment.

Referring now to FIGS. 11 and 12, there is illustrated therein the mechanism for rotating the sub-frame 42 about the vertical axis 44. As it was illustrated in FIGS. 4–10 and described in those figures, the sub-frame 42 is supported on casters 46 on the base frame 40, and is rotatable about the vertical axis 44. The sub-frame 42 is mounted on a circular plate 120 having an opening 122 therein encircling the first DC motor 50. The motor 50 is affixed to the base frame 40 and operates the chain and sprocket drive 48. The opening has an angular dimension which is greater than ninety degrees (90°) plus the diameter of the motor 50 such that the sub-frame is rotatable over a ninety degree (90°) angle relative to the base frame 40. Half of this angular displacement is illustrated in FIG. 12. This feature is particularly advantageous for initiating a pass to any one of several soccer players positioned all over a soccer field, and for training a goal tender over the entire goal width without moving the apparatus.

Referring now to FIGS. 13–25, there is illustrated therein the ball support cup 130 for supporting a ball within the striking path the striking leg member 84. The soccer ball is normally supported in a concave rubber cup 130 which is affixed to a movable vertical bar 132. The vertical bar is in turn mounted in a drive block 134 which is movably mounted on a horizontal bar 136. The horizontal bar 136 is affixed to the upright front members 60 of the sub-frame. There are also provided on the slide block 134, third and fourth DC motors 140,142 each having a friction drive wheel for engaging with the horizontal bar 136 and the vertical bar 132 respectively, and for moving the slide block 134 and the support cup 130 relative to the sub-frame 42.

The adjustment of the soccer ball in a lateral directions relative to the sub-frame 42 is useful for varying the point of impact of the boot 98 against the ball, to impart a spin and a curving trajectory to the ball. The action of the fourth motor 142 causes the cup 130 to raise or lower, and to optionally impart a combination of a lob trajectory and vertical spinning motion to the soccer ball being ejected from the apparatus.

Another feature of the apparatus of the preferred embodiment is that a photo-switch 142 is provided on a guide bar 144 near the soccer ball support cup 130 for determining if a soccer ball is present on the cup 130. For safety reasons a ball must be present on the cup 130 to activate the projecting mechanism 28.

A soccer ball storage ramp 64 and control gate 146 are also provided for automatically loading a soccer ball on the support cup 130. The storage ramp and control gate are separately illustrated in FIGS. 16–18. The storage ramp 64 has a rectangular helix shape and covers a full turn inside the enclosure 26 of the apparatus. The control gate 146 is positioned above the low end of the ramp and is operated by a solenoid actuator 148 to let one ball at the time to fall into the support cup 130. The storage ramp of the preferred embodiment has storage capacity of about a dozen (12) soccer balls.

Figure 19:
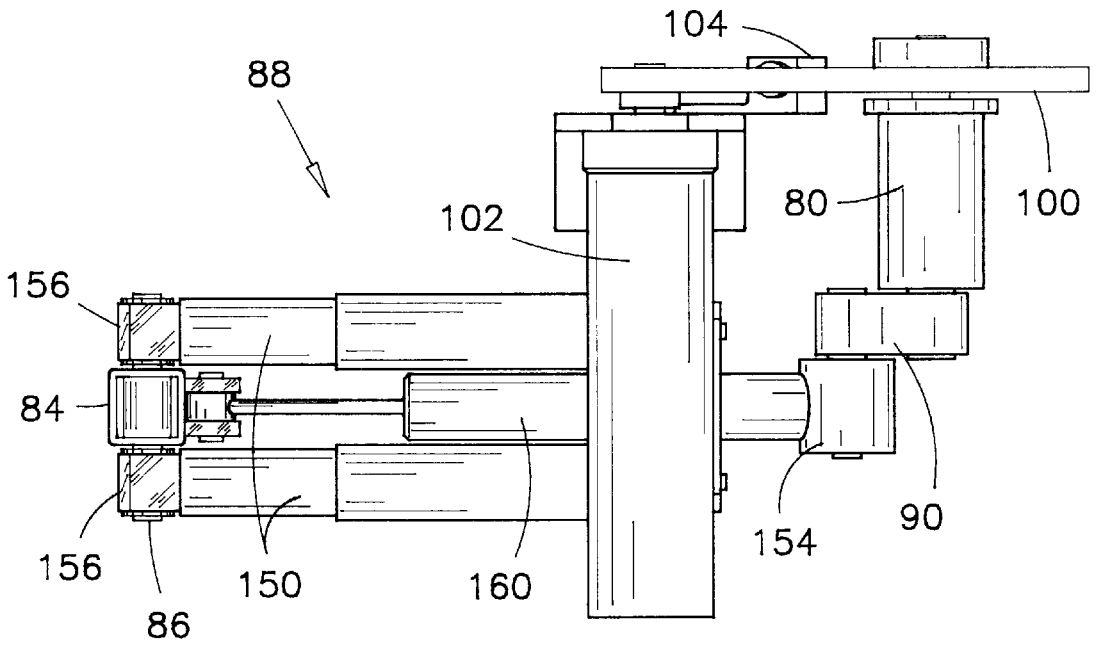
FIG. 19 is a top view of the spring actuator of the ball projecting mechanism.
Figure 20:
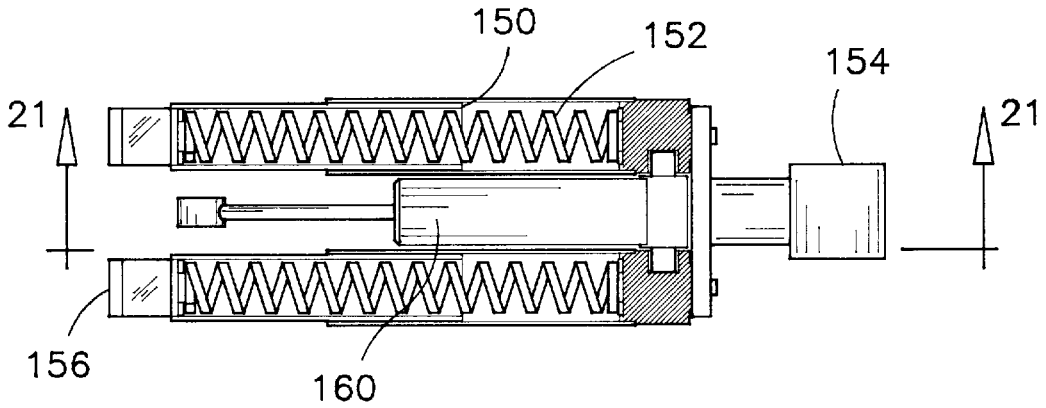
FIG. 20 is a horizontal cross-section through both spring actuators of the ball projecting mechanism.
Figure 21:
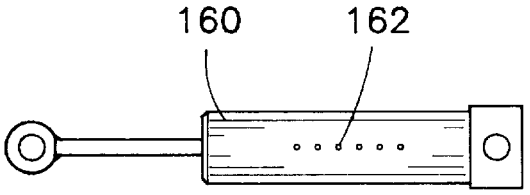
FIG. 21 is a side view of the shock absorber of the ball projecting mechanism as seen along line 21—21 in FIG. 20.

Referring now to FIGS. 19–21, with reference to FIGS. 4–10, the jolt spring assembly 88, comprises a pair of telescoping cylindrical casings 150 each enclosing a spring 152. A first end of both casings 150 are connected to a common bearing 154 which is connected to the crank shaft 90. The second end of both casings 150 each has a rod-end bearing 156 which is connected to the striking leg 84. There is also provided between both casings 150, a shock absorber 160 for dampening the inertia of the striking leg 84 at the end of the striking stroke. The shock absorber 160 is connected to the first ends of the casings 150 and to the striking leg 84. The shock absorber comprises a piston (not shown) mounted inside a cylindrical casing as is customary with commercial shock absorbers. The novel aspect of this shock absorber is that the wall of the casing has a series of perforations 162 therein which are dimensionally spaced along the casing for timely capturing an appropriate amount of air inside the casing and for progressively dampening the striking leg as it approaches the far end of its stroke.

Figure 22:
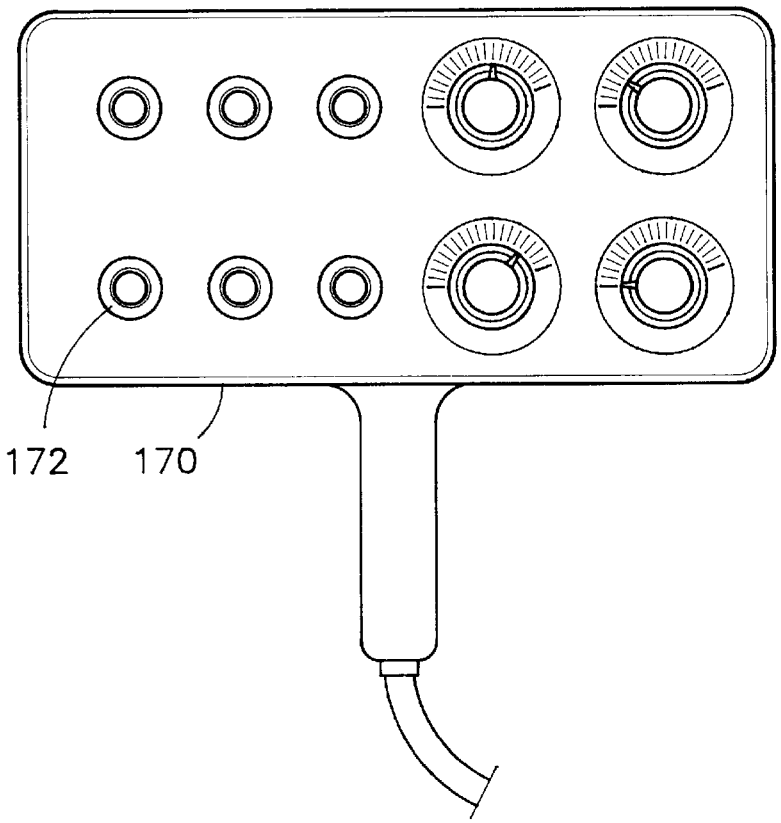
FIG. 22 shows a pendant which is used for operating the apparatus of the preferred embodiment from a remote location.

The operation of the soccer ball projecting apparatus of the preferred embodiment is controlled by a microprocessor 106 as it was mentioned before. The functions of the microprocessor are accessible through a pendant 170 as illustrated in FIG. 22. The pendant 170 of the apparatus of the preferred embodiment is connected to the microprocessor by means of an electrical cable having a substantial length such that the apparatus is controllable from a distance. The pendant of the apparatus of the preferred embodiment has at least nine buttons 172 or control knobs having respectively the following designated functions:

A stop switch to de-energize a program in progress;

A reset button to cause all the components to move to an arbitrary rest position;

A load switch for loading a ball on the support cup 130;

A pre-load control switch for pre-loading the jolt springs 88 to any gradient of a maximum force;

A lob switch to more or less lob the trajectory of the ball;

A side spin switch to move the support cup 130 side-to-side and increase or decrease the spin of a ball;

A vertical spin switch for moving the ball up and down from the impact point;

A swivel switch to rotate the sub-frame 42 and the projection mechanism 28 from side to side; and A throw switch to cause the apparatus to project a ball.

Figure 23:
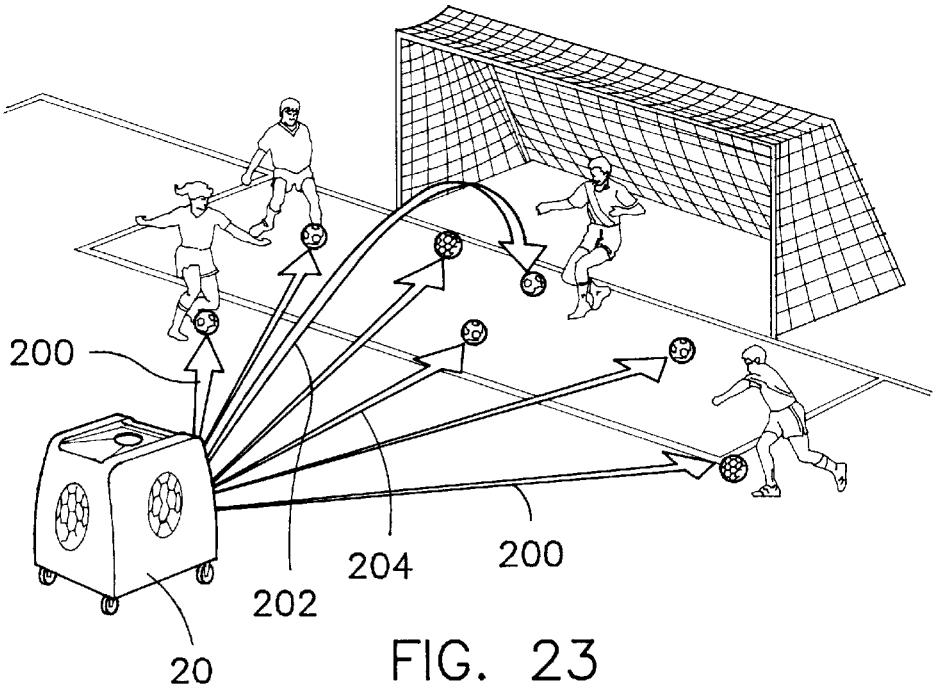
FIG. 23 is a rear perspective view of the apparatus of the preferred embodiment in use in a soccer field.

The soccer ball projecting apparatus of the preferred embodiment is especially efficient in projecting balls in various directions with various degrees of intensity. As best illustrated in FIG. 23, the apparatus of the preferred embodiment can project a ball sideways as shown by trajectory 200, with a high lob 202, a low lob 204, with a spin and a curving trajectories; a low velocity; a high velocity or with multiple combinations of the above features.

It will be appreciated that a number of proximity switches, photo switches and encoders may be used on all friction drive motors, linear actuators and chain and sprocket drives for obtaining a fully programmable operation of the apparatus. These switches and encoders have not been illustrated for being common to the person skilled in the art of electromechanical devices. The apparatus may thereby be programmed to project balls toward a series of predetermined locations according to a specific goal tender training session for example.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, operational features or the like. Therefore, the above description and accompanying illustrations should not be construed as limiting the scope of the invention which is defined in the appended claims.

I claim:

1. An apparatus for projecting soccer balls, comprising:

a frame assembly;

means for projecting a soccer ball mounted in said frame assembly and having a ball striking means incorporated therein; and means for supporting a soccer ball also mounted on said frame assembly in operational association with said means for projecting a soccer ball;

said means for projecting a soccer ball being movably connected to a pair of horizontal pivots having a common axis and being affixed to said frame assembly;

said means for projecting a soccer ball further comprising:

means for adjusting a radial orientation thereof about said common axis for optionally changing an impact point on a soccer ball by said ball striking means when said soccer ball is supported by said means for supporting a soccer ball; and said ball striking means having a striking path oriented toward said common axis, and said common axis passing through said soccer ball supported by said means for supporting a soccer ball such that said radial orientation of said ball striking means and said striking path are adjustable to aim toward a centre of said soccer ball for transmitting to said soccer ball a maximum inertia of said ball striking means, from various orientations of said means for projecting a soccer ball about said common axis.

2. An apparatus for projecting soccer balls as claimed in claim 1 wherein said means for supporting a soccer ball comprises a horizontal axis, a vertical axis and means for positioning said soccer ball along said horizontal and vertical axes.

3. An apparatus for projecting soccer balls as claimed in claim 1, wherein said frame assembly comprises:

a horizontal base frame;

a sub-frame movably mounted on said horizontal base frame; and means for turning said sub-frame over a nominal horizontal angle relative to said base frame, such that said apparatus is able to launch soccer balls over a wide area.

4. An apparatus for projecting soccer balls as claimed in claim 3 wherein said base frame comprises wheels affixed thereto for moving said apparatus about a soccer field.

5. An apparatus for projecting soccer balls as claimed in claim 3, wherein said nominal horizontal angle is about ninety degrees (90°).

6. An apparatus for projecting soccer balls as claimed in claim 1, further comprising:

a number of electric control and drive means for operating and controlling a number of operational functions thereof;

a battery mounted on said sub-frame for supplying electric power to said number of electric control and drive means; and a microprocessor connected to said battery and to said number of electric control and drive means for automatically controlling said number of operational functions, such that said apparatus is programmable for subsequently projecting a number of soccer balls each having different launching characteristics.

7. An apparatus for projecting soccer balls as claimed in claim 6 further comprising a pendant connected to said microprocessor by means of an electric cable of substantial length for controlling said operational functions from a distance from said apparatus.

8. An apparatus for projecting soccer balls as claimed in claim 7 wherein said number of electric control and drive means comprises:

means for loading a soccer ball in said means for supporting a soccer ball;

means for pre-loading said means for projecting a soccer ball;

means for positioning said soccer ball along a said horizontal axis;

means for positioning said soccer ball supported by said means for supporting a soccer ball along said vertical axis;

said means for turning said sub-frame relative to said base frame; and means for causing said means for projecting a soccer ball to strike said soccer ball supported by said means for supporting a soccer ball.

9. An apparatus for projecting soccer balls as claimed in claim 1, further comprising a ball storage ramp mounted above said means for projecting a soccer ball, and gate means affixed to said means for supporting a soccer ball for delivering one soccer ball at a time to said means for supporting a soccer ball.

10. An apparatus for projecting a soccer balls as claimed in claim 9 wherein said ball storage ramp has storage capacity of about twelve (12) soccer balls.

11. An apparatus for projecting soccer balls as claimed in claim 9 wherein said means for pre-loading said means for supporting a soccer ball comprises means for monitoring a presence of a soccer ball on said means for supporting a soccer ball.

12. An apparatus for projecting soccer balls comprising:

a horizontal base frame;

a sub-frame movably mounted on said base frame;

means for projecting a soccer ball mounted on said sub-frame and comprising a ball striking means incorporated therein; and means for supporting a soccer ball mounted on said sub-frame in operational association with said means for projecting a soccer ball;

said means for projecting a soccer ball further comprising:

sprocket and chain drive means for cocking said ball striking means;

said sprocket and drive means comprising a driven sprocket;

means for detecting a rotation of said driven sprocket expressed in number of teeth on said driven sprocket when said ball striking means is being cocked, and controller means connected to said means for detecting a number of teeth and to said sprocket and drive means, for controlling a rotation of said sprocket and drive means such that a degree of cocking of said ball striking means is controllable in increments each corresponding to the width of one tooth on said driven sprocket.

13. An apparatus for projecting soccer balls as claimed in claim 12 wherein each of said increments is about (3%) of a maximum potential energy level of said ball striking means.

14. An apparatus for projecting soccer balls comprising:

a horizontal base frame;

a sub-frame movably mounted on said base frame;

means for projecting a soccer ball mounted on said sub-frame and comprising a ball striking means incorporated therein; and means for supporting a soccer ball mounted on said sub-frame in operational association with said means for projecting a soccer ball;

said means for projecting a soccer ball further comprising:

an arcuated structure having a first end connected to a pair of horizontal pivots having a common axis and being affixed to said sub-frame, and being pivotally movable about said pair of horizontal pivots; and linear actuator means connected to said arcuated structure and to said sub-frame for adjusting a radial orientation of said arcuated structure about said common axis for optionally changing an impact point on a soccer ball by said ball striking means when said soccer ball is supported by said means for supporting a soccer ball;

said striking means comprising an elongated leg member having a first end pivotally connected to said arcuated structure for pendulous movement along a striking path; and said means for projecting a soccer ball further comprising:

a crank shaft pivotally mounted on said arcuated structure and having an axis of rotation perpendicular to said striking path;

a drive means mounted on said arcuated structure and connected to said crank shaft for rotating said crank shaft; and a compressible spring assembly connected between said crank shaft and said leg member for moving said leg member along said striking path between a cocked position and a striking position and vice-versa upon a rotation of said crank shaft; and a latch mechanism for detachably retaining said leg member in said cocked position; and means for moving said leg member from said striking position to said cocked position upon rotation of said crank shaft a first half-turn; and means for compressing said spring assembly upon rotation of said crank shaft a second half-turn when said leg member is adapted to be retained in said cocked position by said latch mechanism and when said crank shaft is adapted to be rotated, such that said leg member is movable back and forth by said crank shaft rotating in a single direction.

15. An apparatus for projecting soccer balls as claimed in claim 14, wherein said drive means comprises a driven sprocket and said apparatus further comprises a switch means for counting teeth on said driven sprocket and means for controlling a rotation of said crank shaft during said second half-turn according to a count of teeth by said switch means.

16. An apparatus for projecting soccer balls as claimed in claim 15 wherein said driven sprocket has 72 teeth such that said means for compressing said spring assembly is controllable with a precision of about three percent (3%) of a maximum potential energy level thereof.

17. An apparatus for projecting soccer balls as claimed in claim 14, wherein said spring assembly comprises a pair of telescoping casings each enclosing a compression spring.

18. An apparatus for projecting soccer balls as claimed in claim 17, wherein said spring assembly further comprises a shock absorber mounted between said telescoping casings for decelerating a striking movement of said leg member.

19. An apparatus for projecting soccer balls as claimed in claim 18, wherein said shock absorber has a casing and said casing has holes therein for gradually capturing air inside said shock absorber for decelerating said striking movement of said leg member.

20. An apparatus for projecting soccer balls as claimed in claim 14, further comprising means for turning said subframe over a nominal horizontal angle relative to said base frame, such that said apparatus is able to launch soccer balls over a wide area.

* * * * *